United States Patent [19]

Gombault

[11] Patent Number: 4,917,662

[45] Date of Patent: Apr. 17, 1990

[54] METHOD AND AN APPARATUS FOR FOLDING PLIABLE MATERIAL, SUCH AS DOCUMENTS, WHICH MAY DIFFER IN QUALITY AND LENGTH AND WHICH ARE CONVEYED IN ASSEMBLED FORM OR SUCCESSIVELY

[75] Inventor: Jacobus F. Gombault, Drachten, Netherlands

[73] Assignee: Hadewe B.V., Drachten, Netherlands

[21] Appl. No.: 257,923

[22] Filed: Oct. 14, 1988

[30] Foreign Application Priority Data

Oct. 14, 1987 [NL] Netherlands ..... 8702457

[51] Int. Cl.[4] ..... B65H 9/10; B65H 45/12

[52] U.S. Cl. ..... 493/416; 493/462

[58] Field of Search ..... 493/304, 416, 454, 462, 493/405

[56] References Cited

FOREIGN PATENT DOCUMENTS 1209986 2/1966 Fed. Rep. of Germany ..... 493/419

*Primary Examiner*—Frederick R. Schmidt
*Assistant Examiner*—Jack W. Lavinder
*Attorney, Agent, or Firm*—Burns, Doane, Swecker & Mathis

[57] ABSTRACT

A method and an apparatus for folding pliable material, such as documents, which may differ in quality and length and which are conveyed in assembled form or successively in a transport track. The material is provided with a fold by bending the leading edge and a contiguous portion of the material out of the plane of transport, creating a folding area by guide means and forming the folding edge by folding means. The bending out of the plane of transport of the leading edge and the contiguous portion of the material takes place during the conveying of the material, the bringing into a tubular form of the material, the flattening of the tubular form, and the feeding of the material in that flattened form to the folding means. The apparatus comprises a transport track with feeding means and, as viewed in transport direction, folding means arranged downstream thereof, as well as guide means arranged between the feeding and the folding means. The guide means form a composite hollow body having a substantially tubular inner surface and an insertion opening.

21 Claims, 2 Drawing Sheets

METHOD AND AN APPARATUS FOR FOLDING PLIABLE MATERIAL, SUCH AS DOCUMENTS, WHICH MAY DIFFER IN QUALITY AND LENGTH AND WHICH ARE CONVEYED IN ASSEMBLED FORM OR SUCCESSIVELY

This invention relates to a method of folding pliable material, such as documents, which may differ in quality and length and which are conveyed in assembled form or successively in a transport track, and wherein the folding material is provided with a fold at a place spaced before its trailing edge, by bending the leading edge and a contiguous portion of the material out of the plane of transport and creating a folding area by guide means, in which area subsequently the desired sharp folding edge is made by folding means, as well as to an apparatus for performing such a folding method.

For folding to size and collecting pliable material, such as documents, which are to be placed in an envelope, three methods can be used in principle. In the first, the collection and filling takes place on a filling machine, while the folding is effected on separately arranged folding machines. In the second, it is possible to fold and fill on a filling machine with integral folding units, one for each document to be folded. Finally, the documents can first be collected and then be folded jointly in superposed relationship, after which the resulting pack is inserted in an envelope. It will be clear that the latter method requires the lowest investment. Moreover, in that method the setting operations are simplest. In the first method, the personnel cost are highest, since it is a multi-phase method.

The third method is therefore preferred; however, this too, entails a number of problems. Known folding systems using folding tables or folding blades cannot handle half of the possible paper size combinations, because documents smaller than the largest size in a pack in most cases are not sufficiently guided and hence remain in the folding unit after the performance of the folding operation and the discharge of the folded pack. This problem is aggravated when documents should be capable of being added selectively to a pack, because in that case the largest document size of one pack may deviate from that of another following or preceding pack.

Furthermore, the known systems generally give problems during the handling of relatively rigid products, such as credit cards, which e.g. have to be attached to a larger document. The latter problem can be solved when at least a part of each document continues to follow a substantially straight path during the folding process, which is not the case in the above known folding methods.

This is the case in a method and apparatus as disclosed in EP-A-59357. In these, use is made of folding tables in the form of rotary cylinders having a slot extending radially through the cylinder. In the starting position the slot is flush with the transport track. The leading edges of incoming documents enter the slot. When the desired part of the document is within the slot, the cylinder is rotated. The part of the document situated outside the slot is taken along and beds down on the outer face of the cylinder, which is enabled among other things by the feed rollers moving apart. After half a revolution of the cylinder, the document lies with the folded area first in the transport track, which provides for its discharge while applying a sharp folded edge. With this method and apparatus all possible document size combinations can be handled. Entirely non-pliable materials can also be handled, provided these can always be inserted entirely into the slot of the cylinder during a folding operation.

However, this known method entails high cost, on the one hand due to the required relatively extensive and complex equipment and on the other hand due to the complicated control. Besides, troubles may arise during paper handling by widely varying causes. In such a case the rotary slotted cylinder causes poor accessibility of the interior of the apparatus and hence cumbersome removal of the cause of the trouble. A further inherent difficulty in this known method is that each fold to be made in a document requires a separate folding step. If an optimum working speed is desired, the number of available folding devices in a handling line should be equal to the maximum number of folds to be made in a document, which can mean a very considerable investment.

EP-A-113358 further discloses a folding apparatus wherein two guide plates are arranged behind the feed rollers on either side of the transport track and substantially parallel thereto, along the front end of which guide plates a steering roller attached to swivelling arms is movable. The folding rollers - as viewed in transport direction - are arranged beyond the swivelling range of the steering roller. A document is passed between the guide plates until the place where the folding edge is to be made is located adjacent the front end of the guide plates. By swivelling movement of the steering roller from one side of the transport track to the other, the document is bent around the front end of either of the guide plates. Swivelling back of the steering roller causes the document to be folded into a V-shape, whereafter the document is guided between the folding rollers with the folded area first.

In this known method, the parts of the documents to be folded over have to be guided beyond the ends of the guide plates, which practically always means transporting them past the folding rollers. The swivelling steering roller causes the part of the documents ahead of the guide plates to be turned back, so a part of the documents should be retracted through the folding rollers. This not only means switching off the drive of the folding rollers, but also moving them apart, and chafing the document along at least one of the rollers. This known method, too, requires a number of folding devices equal to the maximum number of folds to be made in a document to achieve optimum handling speed.

It is an object of the present invention to improve a folding method of the above described type in such a manner as to eliminate the above drawbacks.

This is achieved, according to the present invention, by bending the leading edge and the contiguous portion of the pliable material out of the plane of transport during the feeding of the pliable material, bringing the material into a tubular shape, which shape may or may not be circumferentially closed, depending upon the length of the material, flattening the tubular shape, to form one or two folding areas, and feeding the material in that flattened form to the folding means. By virtue of these features, prior to reaching the folding rollers, the material to be folded is deflected out of the transport track and brought into a tubular shape, which is decisive for the eventual height of the flattened material. Consequently, the circumference of the tubular shape should be at tuned to this height, more in particular it should be twice said height. In this way the pliable material can be folded in a surprisingly simple manner, while the additional advantage is obtained that, without changing the setting, and irrespective of the length of the material fed, the desired number of folds is applied in one pass, thereby economizing relatively to the known methods both on handling and setting time and on apparatus.

The tubular shape is realized by passing the pliable material along basically stationary guide means, from which it may follow that in principle only a simple steering is required, while moreover the required apparatus can be optimally accessible, so that e.g. troubles in the material transport can be detected and remedied easily.

When, in accordance with a further preferred embodiment of the present invention, the tubular shape is flattened into a plane extending parallel to the plane of transport, the flattened tubular shape, or the folded sack of material can be discharged without more ado in a position wherein the material had been fed, i.e. the folding step can be interposed mostly without problems in a handling line. In cases wherein a difference in level to a downstream transport track has to be bridged, it may be preferred, according to a further embodiment of the present invention, that the tubular shape is flattened into a plane which - as viewed in the direction of supply over the plane of transport - encloses an angle with the plane of transport. Thus, the method according to the present invention is not only simple and quick, but moreover provides a wide variety of possibilities as regards the discharge position for the folded material. This is mainly due to the fact that folding takes place basically outside the transport track.

This last feature offers more variation possibilities, i.e. as regards the discharge direction of the folded material. When discharge is desired to be in line with the direction of supply, this can be realized according to a further embodiment of the present invention when the flattened tubular shape is fed to the folding means with a folding area first. This method of discharge is preferred when the pliable material has to be inserted in a conventional envelope, i.e. an envelope having its mouth at one of its long sides. When an envelope with a lateral closure is to be filled, i.e. where the mouth is at one of the shorter sides, it is preferred according to a still further embodiment of the present invention that the flattened tubular shape is fed to the folding means sideways with an end edge of the tube, i.e. a side edge of the material in leading position, i.e., the direction of discharge is perpendicular to the direction of supply.

The flattening of the tubular shape can be effected in many ways. Reference has already been made to the various positions which the flattened material can occupy by a corresponding choice of the position of the plane into which the material is flattened. A further range of possibilities is provided in that also the distance from that plane relative to the transport track is not forcibly fixed, but, if desired, starting from the plane of transport, can be varied without more ado over a distance equal to the cross section of the tubular shape by flattening the tubular shape from one or from two sides. When in accordance with a further embodiment of the present invention, it is preferred that the flattening is effected in a direction towards the plane of transport, not only the flattening can be effected with a simple movement of a single member, but likewise an ideal starting position can be obtained for the mostly desired discharge of the material in the plane of feeding.

When non-pliable parts are present in a pack of pliable material to be folded, the trailing portion of the material should always remain in the transport track, i.e. should be bent to a non-tubular form. This trailing portion should then contain all the non-pliable parts present. Advantageously the trailing portion, remaining in the transport track during the entire folding operation, can then be taken as reference portion for determining the folding place or places. In view of this, it is preferred according to a still further embodiment of the present invention that during the feeding of an assembled pliable material, this is fed with its trailing edges in jogged state, so that the place of any non-pliable parts is always accurately determined. Moreover, it is preferred in that case that during the feeding of the material, the trailing edge thereof is detected, which detection is used for applying the fold or folds to be made at the desired location.

The present invention also relates to an apparatus for folding pliable material, such as documents, that may mutually differ in quality and length and are fed in assembled state or successively, which apparatus, as e.g. disclosed in EP-A-59357, is provided with a transport track with feeding means and—as viewed in transport direction—folding means arranged downstream thereof, as well as guide means disposed between the feeding and the folding means. This allows a method as described above to be performed advantageously when in accordance with the present invention, it is ensured that the guide means form a composite hollow body having a substantially tubular inner surface and an insertion opening with—as viewed in the feed direction—a contiguous deflection face forming part of the tubular inner surface, as well as flattening members movable between a first position outside the tubular inner surface, at least being tangent thereto, and a second position wherein only a small space remains between the flattening members. These features allow to bring the pliable material in a simple manner into the desired tubular shape by only continuing the feed transport; the insertion opening and the contiguous deflection face then ensure the automatic introduction of the desired shape. The material to be folded can be pushed entirely into the composite body. However, it is also possible that the trailing portion of the material remains for the major part outside the composite body, which method will be followed in particular when the pack contains non-pliable parts. In that case, the material is pushed so far into the composite hollow body that after flattening the tubular form, the distance from the trailing edge of the non-inserted portion to the first fold is equal to the desired, folded height of the pliable material. When the length of the inserted material portion from the above first fold is larger than the desired, folded height of the material, the leading edge of such portion will be guided in such a manner that, upon flattening, a second fold is formed and, depending upon said length, possibly a third or further fold, which folds are all obtained in one and the same folding operation. Naturally, this also applies when the material is pushed entirely into the composite, hollow body.

The composite, hollow body can be collapsible totally, e.g. by means of springs or hinges. The tubular inner surface then passes into flattening surfaces, which is possible in that the inner circumference of the tubular face is substantially equal to the outer circumference of the flattened and thus folded material. However, it is preferred that separate flattening members are provided, it being likewise preferred according to a further embodiment of the present invention that those portions of the composite, hollow body that during the bringing into the second position of the flattening members, would hinder or prevent the extension concomitant with the flattening of the tubular form, can be brought out of the path of the extension. The latter could be effected by pushing aside said portions against spring force. However, it is preferred that, in accordance with a further embodiment of the present invention, the composite, hollow body comprises:

a first portion forming one of the walls of the insertion opening, a second portion forming the other wall of the insertion opening, a third portion having a substantially quarterly circular inner configuration and being contiguous to the first portion, a fourth portion having a substantially quarterly circular inner configuration and being contiguous to the second portion, a fifth portion having a substantially quarterly circular inner configuration and being contiguous to the fourth portion, a sixth portion having a substantially quarterly circular inner configuration and being contiguous to the third portion, a seventh portion having a substantially planar shape and being contiguous both to the fifth and the sixth portion, at least the third and the fourth portion being mounted for swivelling away motion, thereby breaking the tubular configuration.

Since in such a configuration, the fourth portion is mostly disposed directly underneath the feed transport track, it will mostly be preferred in actual practice that the fourth and fifth portion are mounted for joint swivel-away action, thereby allowing the fourth portion to swivel away substantially parallel to the plane of transport.

When during flattening one or a number of portions of the composite, hollow body are retained in position and/or used for guiding the tubular shape during flattening, this results in that at least one of the flattening members should intersect the composite, hollow body. This can be realized according to a still further embodiment of the present invention when at least the fourth, fifth and sixth portion are made of a plurality of juxtaposed, interspaced striplike elements and that at least one of the flattening members is made of a plurality of juxtaposed, interspaced striplike elements, the latter striplike elements being so dimensioned and arranged that these are movable unimpededly transversely to the tubular form in the interspaces of the first mentioned striplike elements.

During flattening of the tubular shape, this extends. From the viewpoint of guidance, this effect can be put to advantage when according to a further embodiment of the present invention the sixth portion is stationary and is provided with a guiding surface continuing from the transition to the third portion, thereby always being tangent to the tubular inner surface when this becomes longer, and extending in the direction of the folding means. Due to the swivelling away of the third portion and the elongation, the fold being formed during flattening will move automatically in the direction of the folding means, without a drive being imposed to the pliable material in that direction.

When furthermore the first portion is made of a plurality of juxtaposed, interspaced striplike elements and the third portion is made of a plurality of juxtaposed, interspaced striplike elements, the latter striplike elements being so dimensioned and arranged that these are movable unimpededly transversely to the tubular shape in the interspaces of the first mentioned striplike elements of the first portion, which is stationary, and which is provided with striplike extensions intersecting the striplike elements of the third portion in the position forming the tubular shape and extending in the direction of the folding means, thereby forming a part of the second flattening member, which is further formed by the stationary second portion and an extension thereof, not only the swivelling away of the third portion can be effected in a simple manner, but there is also formed a second flattening member located at the level of the plane of feed. If the discharge of the flattened material is to take place along said plane at that level, this can be realized in a comparatively simple manner when in accordance with a still further embodiment of the present invention, the first flattening member extends parallel to the second, and is movable in the direction thereof, while together with said displacement a roller is displaced that in the second position of the flattening members, will coact with a further roller being stationary adjacent the second flattening member, the arrangement being such that a tubular form flattened between both flattening members is moved in the direction of the folding means when one of the rollers is driven.

The insertion of the pliable material into the insertion opening can be effected in many ways. However, it is preferred that the feeding means comprise at least one stop member reciprocatable along the transport rack in the direction of the insertion opening. In this method of displacement of the pliable material, the position of the trailing edge thereof, often being used as reference line for the folding process, is always accurately known. In this case, moreover, a directly visible setting of the extent to which the material is introduced into the hollow body can be provided in a simple manner, when in accordance with a further embodiment of the present invention, there are provided adjustable means which fix at least the minimal distance between the insertion opening and the stop member. Likewise, this allows to make a quick and reliable setting, ensuring that non-pliable parts of the material remain outside the hollow body.

A setting of the desired, folded height of the pliable material can be obtained when according to a still further preferred embodiment of the present invention, there are provided adjustable means through which the circumferential dimensions of the tubular inner surface of the composite, hollow body can be varied. This can be realized in a comparatively simple manner when according to a further embodiment of the present invention the adjustable means comprise a rotation shaft for the fourth and fifth portion, said shaft being movable parallel to the plane of transport.

Some embodiments of the folding method and apparatus according to the present invention will now be described, by way of example, with reference to the accompanying diagrammatic drawings, in which.

Figure 1:
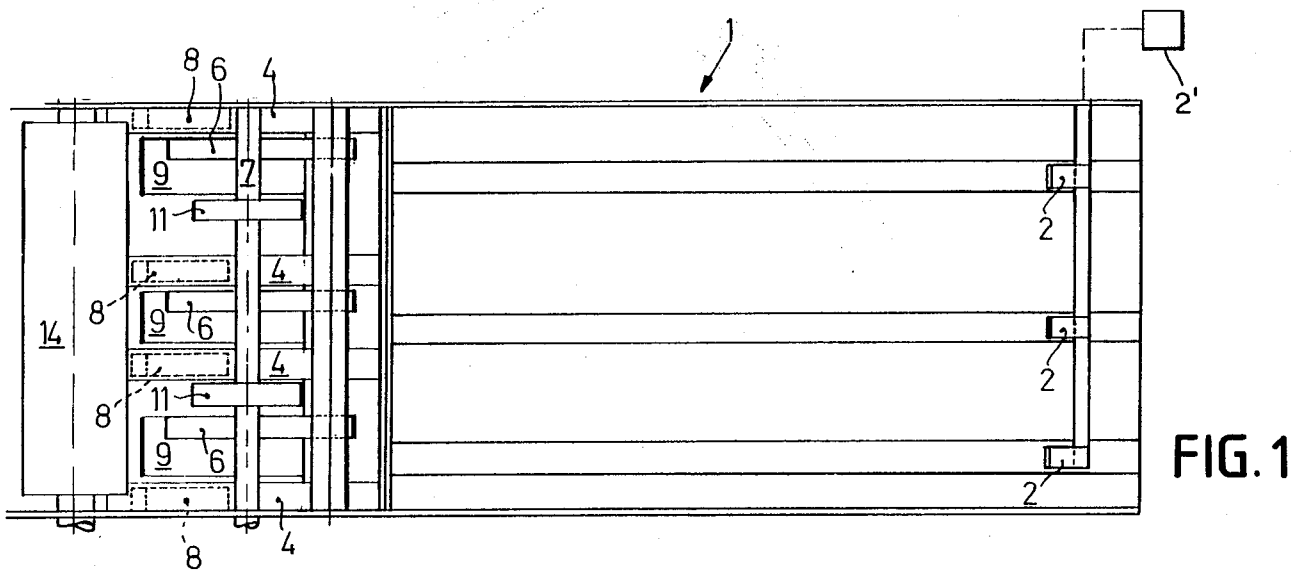
FIG. 1 is a top elevational view of a folding apparatus.
Figure 2:
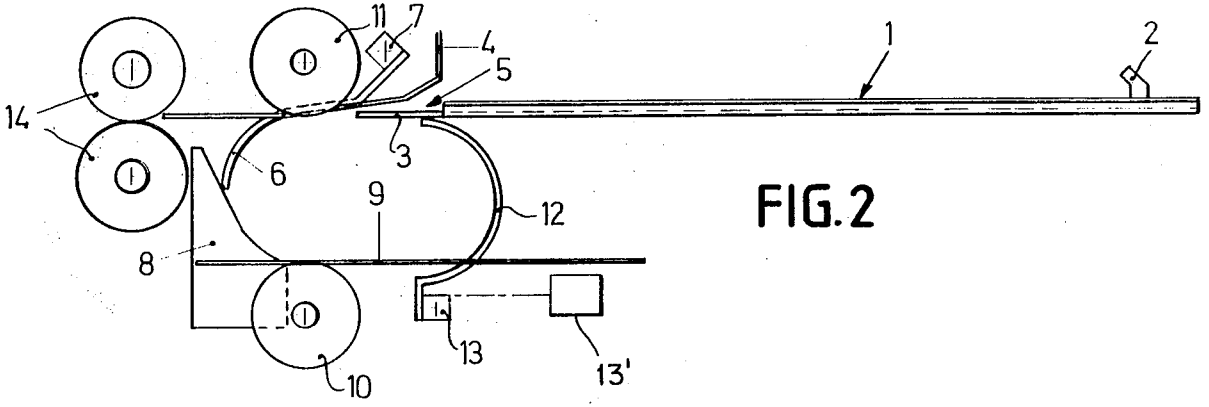
FIG. 2 is an exploded side view of the folding apparatus shown in FIG. 1.

The folding apparatus shown in FIGS. 1 and 2 comprises a transport track 1 having displacement means in the form of pusher lugs 2. The transport track 1 terminates in a plurality of stationary guide fingers 3 (second portion) which together with a plurality of superposed guide fingers 4 (first portion) form an insertion opening 5. Offset relative to guide fingers 4 are a plurality of guide members 6 (third portion) which on their one end are pivotal about a shaft 7 and on their other end terminate in a substantially quarterly circular portion, which is thus pivotal from a position underneath guide fingers 4 as far as a position thereabove.

Offset relative to guide members 6 and e.g. as shown in FIG. 1 in the same vertical plane as guide fingers 4, are a plurality of stationary guide lugs 8 (sixth portion) having a guide surface contiguous to the quarterly circular part of guide members 6 and forming a substantially semicircular guide path.

Between guide lugs 8 are provided a plurality of horizontal platelike flattening members 9 (seventh portion) which—as viewed in FIG. 2 from guide lugs 8—extend to the right beyond guide fingers 3 and to some distance underneath transport track 1. Flattening members 9 are arranged in such a manner that, while remaining in their horizontal position, they can be lifted vertically, said displacement being possible between a first position, in which the flattening members 9 pass more or less smoothly into a straight extension of the semi-circular track formed by guide members 6 and guide lugs 8, and a second position in which the flattening members 9 are present in the immediate vicinity of the horizontal portions of guide fingers 3, 4, said horizontal portions forming the second flattening members.

Two rollers 10 are displaced together with flattening members 9. The rollers 10 are arranged substantially underneath and between flattening members 9, the apex of the circumferential plane being at the level of or just above the top surface of flattening members 9. When the flattening members 9 arrive in the second position, rollers 10 can coact with similar rollers 11, which are arranged between and substantially above guide fingers 3, with the base of the circumferential plane being at the level of or just below the bottom surface of guide fingers 3. Rollers 11, as guide fingers 3, are stationary and naturally arranged offset relatively to guide fingers 4.

Offset relative to flattening members 9 are a plurality of guide elements 12 (fourth and fifth portion), which on their one end are pivotal around a shaft 13 arranged in stationary relationship underneath flattening members 9, and for the rest have a substantially semi-circular inner surface. The other end of guide elements 12 passes more or less smoothly into the straight guide fingers 3, while a similar transition prevails between guide elements 12 and flattening members 9, when the latter are in their first position.

A fourth more or less smooth transition is situated at the point of intersection of guide fingers 4 and guide members 6 when the latter are in their downwardly swivelled position. The parts of guide fingers 4 then extending beyond guide members 6 extend horizontallY and, as alreadY observed, form a part of the second flattening members. Provided on the end of said parts of guide members 6 is a set of folding rollers 14 extending continuously along substantially the entire width of the folding apparatus, at least the transport track 1, as shown in FIG. 1.

Figure 3:
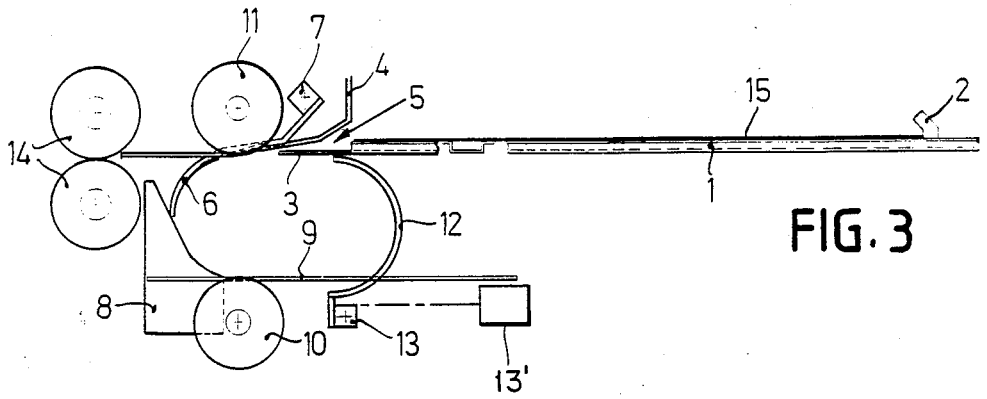
FIGS. 3–6 show a number of successive stages during the operation of the folding apparatus shown in FIGS. 1 and 2.

For the purpose of folding pliable material, such as a document 15 or a plurality of assembled documents, said document or assembled documents is or are placed on the transport track 1, as shown in FIG. 3. This placement can be done manually but likewise automatically by taking appropriate steps, from a feeding station, e.g. from a preceding handling device, such as a printer, burster, sorting device or the like. When assembled documents are to be handled, these are fed preferably with the trailing edges jogged. The trailing edge of the document 15 or assembled documents is placed against pusher lugs 2, after which the folding apparatus is put in operation. The pusher lugs 4 then displace document 15 or assembled documents in the direction of insertion opening 5, whereby a guidance takes place by guide fingers 3 and 4. A further insertion into insertion opening 5 of document 15 or assembled documents results in that the leading edge thereof is bent over in downward direction by guide members 6, which deflection effect is then taken over by guide lugs 8. When reaching the end of the guidance by guide lugs 8, the leading edge comes into contact with flattening members 9, after which said leading edge, upon continued displacement, moves along flattening members 9, i.e. in a direction opposite to the feeding direction. This displacement is continued until the leading edge reaches guide elements 12, which impose an upward deflection to said leading edge. At the end of guide elements 12, the guidance is taken over by the lower surface of guide fingers 3. When the leading edge leaves said guide fingers 4, the leading edge comes into contact with a part of document 15 or assembled documents then inserted into insertion opening 5, with which this has been brought into a continuous tubular shape whose inner surface may again serve as a guiding face for the further inserted leading edge. The insertion is continued until the pusher lugs have reached a preset position. It will be clear that when the document length is not sufficient, no closed tubular shape is obtained. For the handling steps to be discussed hereinafter, the obtainment or non-obtainment of a closed tubular shape is irrelevant for the obtainment of the desired effect.

Figure 4:
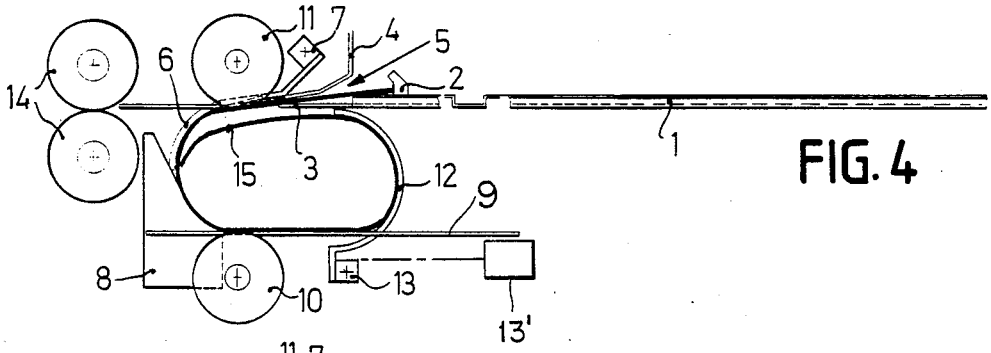

When the displacement of pusher lugs 2 is stopped, the position shown in FIG. 4 can be reached, depending upon the setting of the end position of pusher lugs 2 as determined by the adjustment device 2'. As shown in FIG. 4, a part of document 15 has not been deflected out of its plane of transport. This setting is preferred when non-pliable documents are present in an assembly, which then may be situated without any problem in the non-deflected part. Besides, this setting may depend upon the place of an address provided on the upper document, which should appear behind the window of a window envelope.

Figure 5:
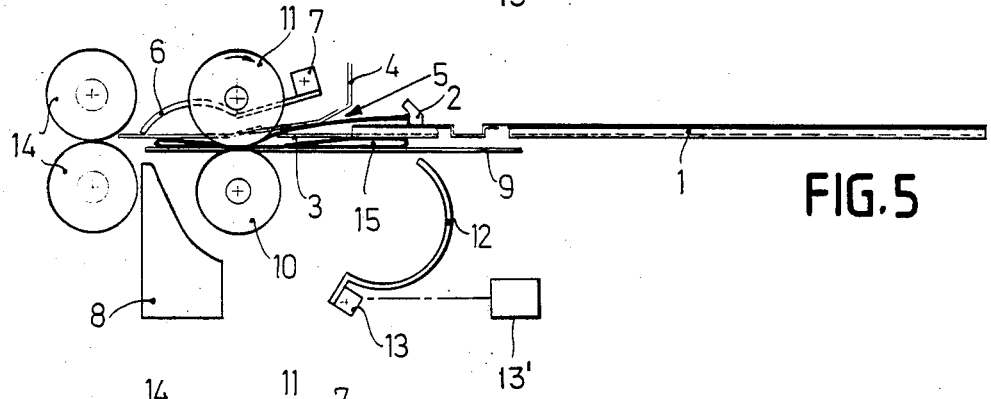

After reaching the position shown in FIG. 4, the flattening members 9 are lifted vertically from their first position, thereby flattening the tubular shape. For the purpose of not impeding the extension of the tubular shape in horizontal direction caused thereby, the guide elements 12 swivel to the right and the guide members 6 upwards, as shown in FIG. 5. During the swivelling away, said parts may then have a guiding function for the flattened and lengthened tubular form. A guidance is also ensured by the guide lugs 8, which bring the folding area being formed during flattening, i.e. the leftmost portion of the tubular shape whose radius of curvature becomes increasingly smaller, upwards and to the left in the direction of folding rollers 14. FIG. 5 shows the position wherein the flattening members 9 have reached their second position and the tubular shape has been flattened.

Figure 6:
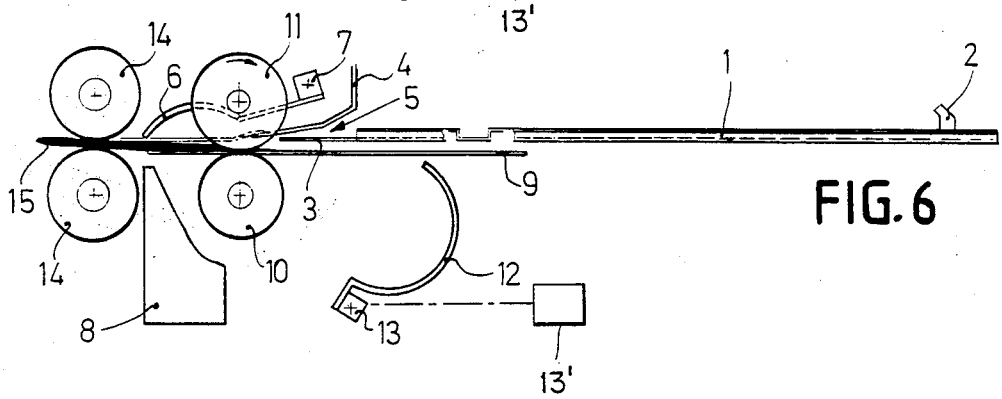

The rollers 10 have been lifted together with flattening members 9, so that the flattened tubular shape has come to lie in the nip between rollers 10 and 11. By driving e.g. rollers 11, the flattened tubular shape can now be displaced in the direction of folding rollers 14. As the folding rollers extend along the extire width of the folding apparatus, these will transform the leading folding area guided therebetween to a sharp folding edge, which situation is shown in FIG. 6. The further displacement of the flattened tubular shape results not only in its discharge, but moreover in the application of a second sharp folding edge at the trailing end of the flattened tubular shape, so that this can be immediately further processed in entirely ready state, e.g. inserted into an envelope. It may be clear from the foregoing that the trailing part of document 15 of assembled documents remains substantially straight in this method of flattening and discharging and can thus contain non-pliable parts without any problem.

It is self-evident that many modifications and variants are possible within the scope of the present invention. For instance, parts 6, 8 and 12 may have such a resilient or pivoting design that these are foldable in a horizontal flat shape, thereby creating at the transition between parts 6 and 8 a discharge opening that connects to folding rollers 14. Besides, it is possible to turn the shafts of rollers 10 and 11 a quarter of a turn, so that the discharge of the flattened tubular shape takes place perpendicularly to the plane of drawing. Naturally, in that case the arrangement of the folding rollers should one adjusted thereto. The discharge of the flattened tubular shape in the embodiment shown takes place in horizontal direction and at a level adjacent the transport track 1. By providing two sets of displaceable flattening members, any differently directed discharge position and any other discharge level can be realized by corresponding displacement of the flattening members relative to the tubular shape during its flattening. The variation of the desired, folded document height e.g. for adjustment to an envelope of deviating height, can be realized by varying the mutual positions of the guide portions effecting the tubular shape. This can be realized for instance by designing shaft 13 of guide elements 12 so as to be displaceable in horizontal direction as determined by the adjustment device 13'.

I claim:

1. A method of folding pliable, paperlike material, such as documents, which may differ in quality and length and which are conveyed in assembled condition or successively in a transport track, said material being provided with a fold in a location at some distance before a trailing edge by bending a leading edge and a contiguous portion of the material out of the plane of transport and creating a folding area by guide means, in which area subsequently a desired sharp folding edge is made by a folding means, characterized by bending the leading edge and the contiguous portion of the material out of the plane of transport during a feeding of the material, brining the material into a hollow tubular shape by displacing said leading edge and contiguous portion along a stationary means that forms a hollow body with an inner tubular guiding face, which shape, depending upon the length of the material, is completely or partly circumferentially closed, flattening the tubular shape to form at least one folding area, and feeding the material to the folding means in flattened form.

2. A method as claimed in claim 1, characterized in that the tubular shape is flattened into a plane extending parallel to the plane of transport.

3. A method as claimed in claim 1, wherein the tubular shape is flattened into a plane which is inclined at an angle ranging from about 0° to about 90° with respect to the plane of transport.

4. A method as claimed in claim 1 characterized in that the flattened tubular shape with a leading folding area is fed to the folding means.

5. A method as claimed in claim 1 characterized in that the flattened tubular shape with a leading end edge or side edge of the folding material is fed to the folding means.

6. A method as claimed in claim 1 characterized in that the flattening is effected in a direction towards the plane of transport.

7. A method as claimed in claim 1 characterized in that during the feeding of assembled material, this is fed with its trailing edges in jogged condition.

8. A method as claimed in claim 1 characterized in that during the feeding of the material, the location of the trailing edge thereof is determined, which determination is used for forming the fold to be made in the desired place.

9. An apparatus for folding pliable material, such as documents, which may have different quality and length, and which are fed in assembled condition or successively, said apparatus comprising a transport track with feeding means and, as viewed in a transport direction, folding means arranged downstream thereof, as well as guide means arranged between the feeding and the folding means, wherein said guide means form a composite hollow body having a substantially tubular inner surface and with an insertion opening as viewed in a feed direction, a contiguous deflection face forming part of the tubular inner surface, as well as flattening members movable between a first position such that said flattening members are separated from each other and substantially tangent to said inner surface, and a second position, in which only a small space remains between the flattening members.

10. An apparatus as claimed in claim 9, said composite hollow body having parts that are movable out of a path of extension of said pliable material during the brining of said flattening members into said second position.

11. An apparatus as claimed in claim 10, characterized in that the composite hollow body comprises:

a first portion forming one of the walls of the insertion opening, a second portion forming the other wall of the insertion opening, a third portion having a substantially quarterly circular inner configuration and being contiguous to the first portion, a fourth portion having a substantially quarterly circular-r inner shape and being contiguous to the second portion, a fifth portion having a substantially quarterly circular inner configuration and being contiguous to the fourth portion, a sixth portion having a substantially quarterly circular inner configuration and being continuous to the third portion, seventh portion having a substantially planar shape and being contiguous both to the fifth and the sixth portion, at least the third and the fourth portion being mounted for swivelling away motion, thereby breaking the tubular configuration.

12. An apparatus as claimed in claim 11, characterized in that the fourth and fifth portion are mounted for being jointly swivelled away.

13. An apparatus as claimed in claim 12, wherein a first flattening member extends parallel to said second flattening member, and is movably displaceable in the direction thereof, while together with said displacement, a roller is displaced that in the second position of the flattening members, will coact with a further roller being stationary adjacent the second flattening member, the arrangement being such that a tubular shape flattened between both flattening members is moved in the direction of the folding means when one of the rollers is driven.

14. An apparatus as claimed in claim 11, characterized in that at least the fourth, fifth and sixth portion are made of a plurality of juxtaposed, interspaced striplike elements and that at least one of the flattening members is made of a plurality of juxtaposed, interspaced striplike elements, the latter striplike elements being so dimensioned and arranged that these are movable unimpededly transversely to the tubular shape in the interspaces of the first mentioned striplike elements.

15. An apparatus as claimed in claim 14, wherein the first portion is made of a plurality of juxtaposed, interspaced striplike elements and that the third portion is made of a plurality of juxtaposed, interspaced striplike elements, the latter striplike elements being so dimensioned and arranged that these are movable unimpededly transversely to the tubular shape in the interspaces of the first mentioned striplike elements of the first portion, which is stationary, and which is provided with striplike extensions intersecting the striplike elements of the third portion in the position forming the tubular form and extending in the direction of the folding means, thereby forming a part of a second flattening member, said second flattening member being further formed by said second portion and an extension of said second portion.

16. An apparatus as claimed in claim 15, characterized in that the extension of the second portion forms part of the transport track.

17. An apparatus as claimed in claim 11, wherein the sixth portion is stationary and is provided with a guiding surface continuing from a transition of the third portion, thereby always being tangent to the tubular inner surface when said inner surface becomes flatter, and extending in a direction of the folding means.

18. An apparatus as claimed in claim 9 characterized in that the feed means comprise at least one stop member being reciprocatable over the transport track in the direction of the insertion opening.

19. An apparatus as claimed in claim 18, characterized in that a first adjustable means are provided which fix at least the minimal distance between the insertion opening and the stop member.

20. An apparatus as claimed in claim 19 characterized in that adjustable means are provided through which the circumferential dimensions of the tubular inner surface of the composite, hollow body can be varied.

21. An apparatus as claimed in claim 20, characterized in that the adjustable means comprise a rotation shaft for the fourth and the fifth portion that is movable parallel to the transport track.

* * * * *